US010347437B2

(12) United States Patent
Johansson et al.

(10) Patent No.: US 10,347,437 B2
(45) Date of Patent: Jul. 9, 2019

(54) DISCONNECTOR DEVICE AND ARRANGEMENT FOR DISCONNECTING A CONTACTOR

(71) Applicant: ABB Schweiz AG, Baden (CH)

(72) Inventors: Gunnar Johansson, Västerås (SE); Markus Angell, Västerås (SE); Alfred Nilsson, Västerås (SE); Linnea Johansson, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/781,411

(22) PCT Filed: Dec. 4, 2015

(86) PCT No.: PCT/EP2015/078626
§ 371 (c)(1),
(2) Date: Jun. 4, 2018

(87) PCT Pub. No.: WO2017/092821
PCT Pub. Date: Jun. 8, 2017

(65) Prior Publication Data
US 2018/0358187 A1 Dec. 13, 2018

(51) Int. Cl.

| | |
|---|---|
| ***H01H 9/22*** | (2006.01) |
| ***H01H 71/10*** | (2006.01) |
| ***H01H 71/56*** | (2006.01) |
| ***H01H 9/28*** | (2006.01) |

(52) U.S. Cl.
CPC ..... *H01H 9/22* (2013.01); *H01H 9/281* (2013.01); *H01H 71/1054* (2013.01); *H01H 71/56* (2013.01)

(58) Field of Classification Search
CPC ..... H01H 9/22; H01H 9/281; H01H 71/1054; H01H 71/56
See application file for complete search history.

(56) References Cited

U.S. PATENT DOCUMENTS 6,437,261 B1 8/2002 Bryant et al.

FOREIGN PATENT DOCUMENTS

| | | | |
|---|---|---|---|
| CN | 2483822 | Y | 3/2002 |
| CN | 201584321 | U | 9/2010 |
| CN | 203871296 | U | 10/2014 |
| DE | 19538389 | A1 | 4/1997 |
| EP | 2797097 | A1 | 10/2014 |
| FR | 2512584 | A1 | 3/1983 |
| GB | 1061890 | A | 3/1967 |

OTHER PUBLICATIONS

International Preliminary Report on Patentability Application No. PCT/EP2015/078626 dated Nov. 29, 2017 6 pages.
International Search Report and Written Opinion of the International Searching Authority Application No. PCT/EP2015/078626 dated Jul. 15, 2016; dated Jul. 25, 2016 10 pages.

*Primary Examiner* — Ramon M Barrera
(74) *Attorney, Agent, or Firm* — Whitmyer IP Group LLC

(57) ABSTRACT

A disconnector device is provided for disconnecting an electrical circuit, wherein the electrical circuit is switched by a contactor between an open position and a closed position, the disconnector device using the contactor for disconnecting the electric circuit. The disconnector device locks the contactor in the open position, in which open position contacts of the contactor are in a first position disconnecting the electrical circuit. An arrangement including the disconnector device and a contactor is also provided.

14 Claims, 4 Drawing Sheets

DISCONNECTOR DEVICE AND ARRANGEMENT FOR DISCONNECTING A CONTACTOR

TECHNICAL FIELD

The technology disclosed herein relates generally to the field of contactors and disconnectors used in electrical networks, and in particular to a disconnector device and arrangement comprising a contactor and the disconnector device for disconnecting an electric circuit.

BACKGROUND

A contactor is an electrically controlled switch used for switching an electrical circuit or electrical device with high current ratings. The contactor is controlled by control circuitry having a much lower power level than the electric circuit or device that is being switched by the contactor. The contactor comprises contacts, i.e. the current carrying part of the contactor, and a mechanism (for instance an electromagnet or coil) for closing and opening these contacts. The contactor is normally a mono-stable remotely operated device, operated e.g. by the mentioned control circuitry. The contactor is built for handling millions of operations and is a very reliable and robust device for this purpose. However the contactor lacks means for providing a safe disconnection when being in open position, i.e. in a position disconnecting the electrical power circuit. Such safe disconnection is a requirement for ensuring that the contacts of the contactor will not close by mistake or by some malfunctioning, as this would be life threatening e.g. for a person servicing the electrical power circuit or device that is being switched by the contactor.

An example of a device for accomplishing such safe disconnection is a switch disconnector. The switch disconnector is normally a bi-stable hand operated device that is built for handling few operations. For instance, in case of emergency it can be used manually for breaking the current, and it can also provide a safe disconnection of the electric circuit or device. The switch disconnector normally lacks the robustness and reliability for handling millions of operations.

Because of their different characteristics the two types of devices, i.e. the contactor and the switch disconnector, are often used together to provide a reliable and safe installation. Traditionally, switching installations are hence built with contactors and switch disconnectors together. The contactor is used for switching the normal load currents while the switch disconnector is used for emergency switching and safe disconnection of the electric circuit or device.

The switch disconnectors are however expensive and may be difficult to operate. They may, for instance, require a fairly high strength if maneuvered by hand. If the switch disconnector is provided with means for remote operation, e.g. in the form of a motor drive, the arrangement of contactor and switch disconnector is rendered complicated as well as expensive. Examples of these known switch disconnectors are disclosed in DE 19538389 and EP2797097.

SUMMARY

An objective of the present invention is to solve or at least alleviate the above mentioned problem.

The objective is according to an aspect achieved by a disconnector device for disconnecting an electrical circuit, wherein the electrical circuit is switched by a contactor between an open position and a closed position. The disconnector device uses the contactor for disconnecting the electric circuit. The disconnector device comprises means for locking the contactor in the open position, in which open position contacts of the contactor are in a first position disconnecting the electrical circuit.

The disconnector device provides several advantages. For instance, the disconnector provides a contactor with an additional feature, by means of which the contactor can provide a complete function, acting as a reliable switch as well as being provided with a safe disconnection means. The disconnector device according to the invention provides a more cost-efficient solution compared to known disconnector devices. Further, the disconnector device according to the invention also enables a smaller complete arrangement of contactor and disconnector to be provided. The disconnector device may be an accessory device to be used with contactors or it may be a built-in feature in the contactors.

In various embodiments, the means for locking the contactor in open position comprises one or both of mechanical locking means and electrical locking means. Such mechanical and electrical locking means may be implemented in different ways.

In an embodiment, the means for locking the contactor in open position comprises first means for mechanically locking the contactor in the open position.

In various embodiments, the means for locking the contactor in open position comprises second means for preventing control circuitry of the contactor to operate.

In various embodiments, the disconnector comprises means for preventing the means for locking the contactor in the open position to be fully operated if the contactor cannot assume the open position. An advantage of this embodiment is that an increased security is provided. A person servicing the electrical circuit or device that is being switched by the contactor is alerted about the fact that the contactor is not safely disconnected.

In various embodiments, the means for locking the contactor in the open position comprises a second shaft inserted into a housing of the contactor, the second shaft mechanically preventing the contacts of the contactor to assume the closed position.

In various embodiments, the disconnector device comprises a first shaft arranged to operate: first means to mechanically lock the contactor in the open position, and second means to prevent the control circuitry of the contactor to operate.

In a variation of the above embodiment, the first shaft is arranged to operate the first means and the second means in a single movement. This embodiment provides an easily operated disconnector device.

In various embodiments, the means for locking the contactor in open position comprises a gear operated by a first shaft, wherein the gear when operated moves a second shaft to a locking position within a housing of the contactor, in which position the contactor is locked in the open position.

In a variation of the above embodiment, the first shaft is prevented from being fully operated if the contactor cannot assume the open position and the second shaft thereby being prevented from assuming the locking position.

In various embodiments, the means for locking the contactor in open position comprises a switch connected electrically to control circuitry of the contactor, the switch de-energizing the control circuitry of the contactor when operated.

The objective is according to an aspect achieved by an arrangement for disconnecting an electrical circuit, wherein the electrical circuit is switched by a contactor between an open position and a closed position, the disconnector device being involved in neither the switching nor isolation of the electric circuit. The arrangement comprises: a contactor arranged to switch an electrical circuit between an open position and a closed position, and a disconnector device according to any of the above embodiments thereof, arranged to disconnect the electric circuit.

Further features and advantages of the embodiments of the present teachings will become clear upon reading the following description and the accompanying drawings.

DETAILED DESCRIPTION

Figure 1:
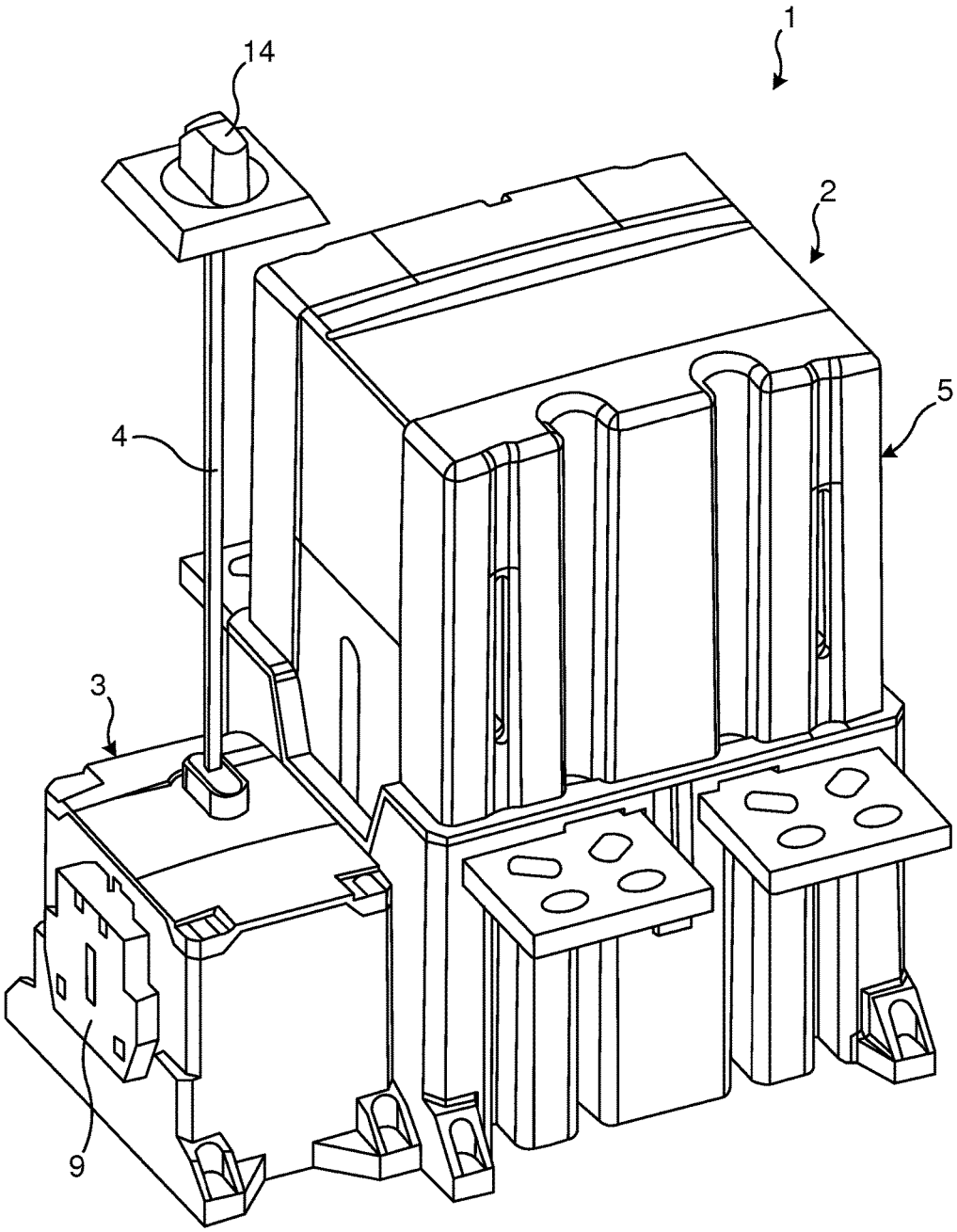
FIG. 1 illustrates an arrangement for safe disconnection of an electrical circuit according to the present invention.

In the following description, for purposes of explanation and not limitation, specific details are set forth such as particular architectures, interfaces, techniques, etc. in order to provide a thorough understanding. In other instances, detailed descriptions of well-known devices, circuits, and methods are omitted so as not to obscure the description with unnecessary detail. Same reference numerals refer to same or similar elements throughout the description.

FIG. 1 illustrates an arrangement for safe disconnection of an electrical circuit according to the present invention. The arrangement 1 comprises a contactor device 2, in the following also denoted contactor 2, and a disconnector device 3, in the following also denoted disconnector 3. The disconnector 3 may, as illustrated in FIG. 1, be mounted on the side of the contactor 2, i.e. mounted to the housing 5 thereof. Electrical wiring may be provided between the control circuit (not illustrated in FIG. 1) of the contactor 2 and a switch 9 provided in the disconnector 3, whereby the control circuit of the contactor 2 may be supplied through the switch of the disconnector 3. According to various embodiments of the invention, such switch may thereby be used as the means (alone or together with mechanical means) for locking the contactor 2 in open position.

Briefly, the disconnector 3 according to the invention comprises means for locking the contactor 2 in an open (non-conducting) position. These means may comprise one or both of mechanical locking means and electrical locking means (e.g. the switch as mentioned above). In an embodiment, the disconnector 3 comprises first means for mechanically locking the contactor 2 in an open position, for instance by means of a first shaft 4. Such first means for mechanically locking the contactor 2 in the open position may, for instance, comprise a gear 7 and a second shaft 8 (described more in detail later). In this embodiment, the disconnector 3 also comprises second means for electrically preventing the control circuitry of the contactor 2 to be operated.

Figure 2:
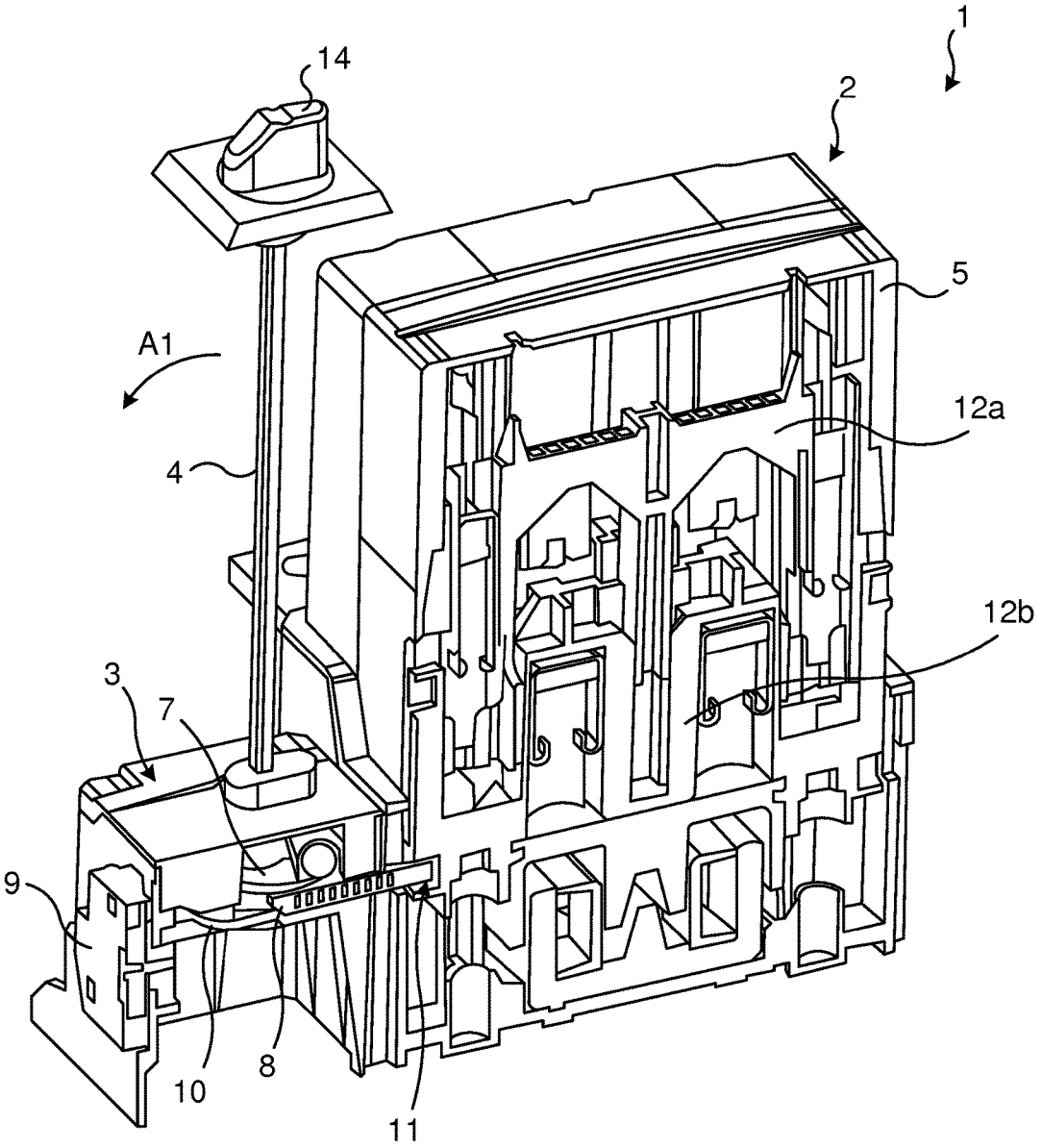
FIG. 2 illustrates the arrangement according to the present invention in a cross-sectional view.

FIG. 2 illustrates the arrangement 1 according to the present invention in a cross-sectional view.

The contactor 2 is, as mentioned, an electrically controlled switch device used for switching, for instance, high electric currents, and is able to make, conduct or break the electric current. In order for the contactor 2 to make or break electrical contact and thereby switch an electrical device or circuit in or out (or equivalently on or off), the contactor 2 comprises a number of contacts, for instance three contacts in the case of a three-phase application, i.e. one contact for each phase. In this context it is noted that the contactor 2 is switching the electrical circuit, and not the disconnector 3. There may be other switching means for switching the electric circuit, but the disconnector 3 is not involved in such switching. This is one aspect that enables the disconnector 3 according to the invention to be kept as a simple, small and low maintenance device, rendering it cost-efficient and easy to handle and use. The disconnector 3 uses the contactor 2 for providing galvanic separation of the electric circuit.

To this end the contactor 2 comprises an actuation mechanism 12*a*, 12*b* for moving the contacts to a closing position in which the electrical circuit is closed and conversely for moving the contacts to an open position in which the electrical circuit is opened. The movement of the actuation mechanism 12*a*, 12*b* is controlled by control circuitry (not illustrated). The details of the actuation mechanism 12*a*, 12*b* are not important for the present invention, and it may be moved in any known manner. For instance, the contactor 2 may be an electromagnetically operated contactor. In such case the contacts are mechanically connected to the actuation mechanism 12*a*, 12*b*, which actuation mechanism 12*a*, 12*b* in turn comprises a part of an electromagnetic circuit. At a first end position the actuation mechanism 12*a*, 12*b* is open and a current path is then open, and at a second end position, the actuation mechanism is closed and the contactor 2 is then closed and thereby providing an electrical path. Movement of the actuation mechanism 12*a*, 12*b* is accomplished by energizing a coil of the electromagnetic circuit, wherein the coil is typically wound around a part of the electromagnetic circuit.

The contactor 2 comprises, as mentioned, control circuitry and when receiving a control signal for opening the circuit or device, the actuation mechanism 12 is moved to the open position (first end position). Correspondingly, when receiving a control signal for closing the actuation mechanism 12*a*, 12*b* is moved to the closed position (second end position). It is noted that the control circuitry may comprise various components, e.g. electric and/or magnetic parts, such as a control circuit, magnets, coils, etc.

The contactor 2 may, in some embodiments, be a contactor device available on the market. That is, existing contactor devices may be used without any adaptations. In other embodiments, some adaptations may be needed. For instance, if the housing 5 of the existing contactor 2 comprises a hole e.g. intended for fastening to a wall, such hole may be used for applying the first means 7, 8 for mechanically locking the disconnector 3 according to the present invention. In such case no, or only minor adaptations are needed to the contactor 2. For instance, the housing 5 may need to be adapted, e.g. the hole may need to be enlarged and/or moved, while the interior design of the contactor 2 may be kept without any adaptations.

As mentioned, the disconnector 3 comprises means for locking the contactor 2 in open position. These means may comprise first means 7, 8 for mechanically locking the contactor 2 in an open (non-conducting) position, for instance by means of a first shaft 4. Such first means 7, 8 may, for instance, comprise a gear 7, e.g. an external gear having teeth formed on an outer surface. The first shaft 4 may comprise a handle 14, which when turned operates the gear 7. That is, by this movement of the handle 14, the first shaft 4 rotates the gear 7. In this embodiment, a second shaft 8 is also provided as illustrated in FIG. 2. The second shaft 8 is housed within the disconnector 3 and at about 90 degrees in relation to the first shaft 4. The teeth or cogs of the gear 7 may then be arranged to move the second shaft 8 as the gear 7 rotates, and in particular move the second shaft 8 through a hole 11 in the contactor housing 5 and into the contactor 2, to thereby lock the contactor 2 in open position. The second shaft 8 may, for instance, enter the hole 11 in such way that the second shaft prevents the lower part 12*b*, of the actuation mechanism 12*a*, 12*b* from moving, and hence also preventing the upper part 12*a* from moving. In the open position the contacts of the contactor 2 are mechanically prevented from closing the electrical circuit that the contactor 2 is arranged to switch.

In other embodiments, two or more gears may be arranged for the same purpose (not illustrated).

In still another embodiment, the first means for mechanically locking the contactor 2 in an open position may comprise the first shaft 4 arranged simply to move the second shaft 8 into the housing of the contactor 2 without a gear, and thereby locking it in open position. That is, in this embodiment, no gear 7 is used. The first shaft 7 may instead, for instance, be arranged to be moved in a tilting movement, as illustrated by arrow A1, and for the case of the disconnector 3 being mounted to one side of the contactor 2, the tilting movement A1 away from the contactor 2 then pushes the second shaft 8 into the contactor 2 and the mechanically locking position.

It is realized that there are several other means for mechanically locking the contactor in an open position.

The disconnector 3 also comprises second means 9, 10 for electrically preventing the control circuitry of the contactor 2 to be operated. Such second means 9, 10 may comprise an electrical switch 9 connected electrically to the control circuitry of the contactor 2, e.g. by the electrical wiring mentioned in relation to FIG. 1. The switch 9 may be arranged such that simultaneously with the first shaft 4 operating on the gear 7, the switch 9 is switched and the control circuitry of the contactor 2 is prevented from being operated. By switching the switch 9, the power supply to the contactor 2 is cut off.

The first means 7, 8 and the second means 9, 10 and the operation thereof are described in more detail next, with reference to FIGS. 3 and 4.

Figure 3:
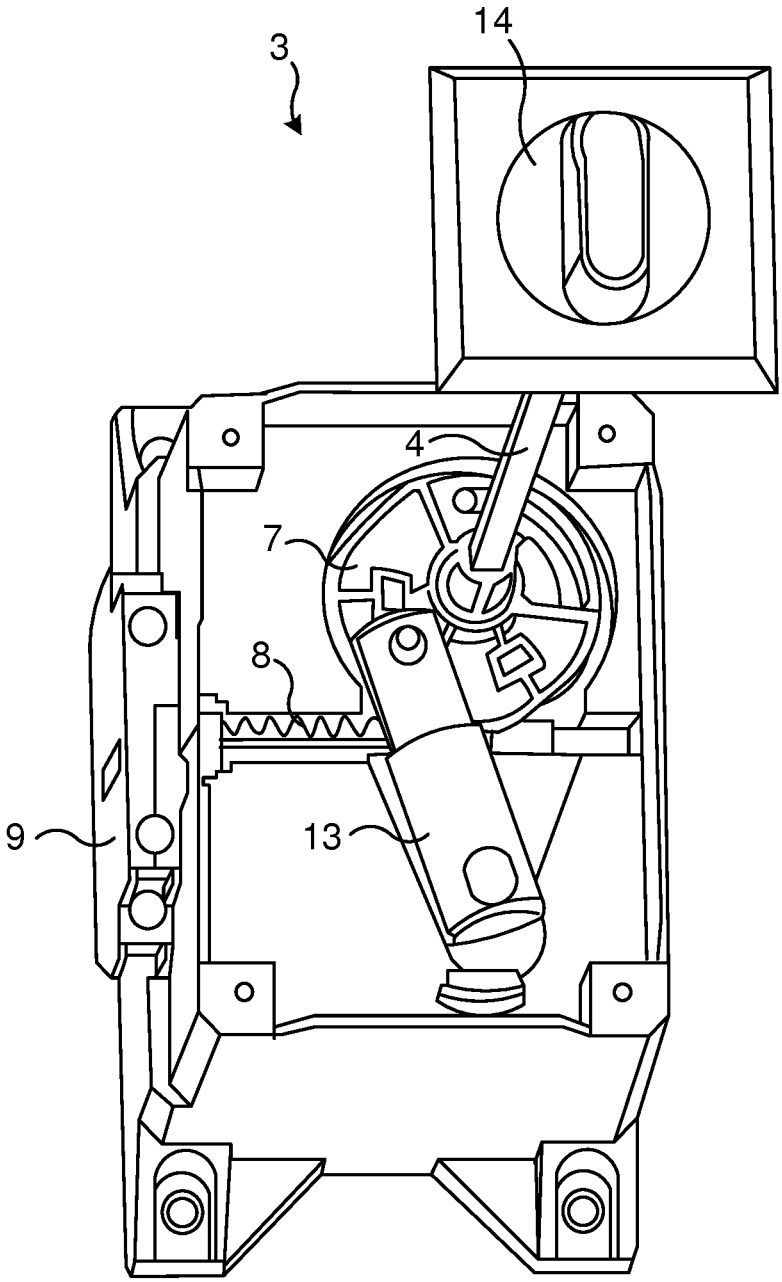
FIG. 3 illustrates the disconnector according to the present invention in a cross-sectional view from above in closed position.

FIG. 3 illustrates the disconnector according to the present invention in a cross-sectional view from above, when in ON-position. ON-position in this regards corresponds to the case that the contactor 2 can be operated between the closed and open position. In the ON-position hence the contactor 2 can be operated to the closed position, i.e. wherein the contacts of the contactor 2 can be closed to lead the current to the electrical circuit or device that it is arranged to switch. The gear 7 may comprise teeth meshing with teeth arranged on the second shaft 8. When the handle 14 arranged on the first shaft 4 is turned to the ON-position, as illustrated in FIG. 3, and the contactor is "on" and in use, then the contactor control circuitry can be energized and de-energized with remote control. Such remote control may, for instance, comprise a control unit arranged to receive parameters relating to the device that the contactor 2 switches and send control signals to the control circuitry of the contactor 2 in accordance therewith. The control circuitry might also be manually controllable. The contactor actuation mechanism 12*a*, 12*b* is also free to operate the contacts of the contactor 2.

The disconnector 3 also has an OFF-position (illustrated in FIG. 4), corresponding to the case that the contactor 2 is "off", i.e. disconnecting the electric circuit.

The first means of the disconnector 3 for mechanically locking the contactor 2 is also shown in more detail in FIG. 3. The first shaft 4 is, in the illustrated embodiment, arranged in mechanical contact with a center point of the gear 7. A compression spring arrangement 13 is fastened at a first end thereof to the gear 7 and at a second end pivotally fastened to the housing of the disconnector 3. The compression spring arrangement 13 may, for instance, comprise two sleeves and a compression spring, having the purpose of holding the gear 7 at its two respective end positions. When moving the handle 14 between its OFF-position and ON-position, the first shaft 4 rotates the gear 7, which in turn moves the compression spring arrangement 13 between two end points of the pivotal movement that the compression spring arrangement 13 makes. As the compression spring arrangement 13 is moved, the second shaft 8 is either inserted to or retracted from the contactor 2: in one of the end positions of the compression spring arrangement 13 the second shaft 8 is in a position in which the contactor 2 is mechanically locked in open position (disconnecting), and in the other end position the second shaft 8 is completely retracted within the disconnector 3. The latter case is illustrated in FIG. 3.

As an additional feature, the handle 14 may be prevented from being fully turned to OFF-position if for any reason the contactor 2 cannot open, i.e. if the circuit or device switched by the contactor 2 is not safely disconnected. The operator, e.g. a person servicing the electrical power circuit or device that is being switched by the contactor 2, is thereby alerted about the fact that the contactor 2 is not safely disconnected. For instance, the opening 11 in the housing 5 of the contactor 2 may be placed such that if the contacts of the contactor 2 are not fully at their open position, but e.g. only half-way, then the second shaft 8 can not enter the opening 11, since e.g. the contacts or the actuation mechanism 12*a*, 12*b* prevents such entering.

The switch 9 of the disconnector 3 may also be arranged to be operated by means of the handle 14. As illustrated in FIG. 2, the switch 9 may be mechanically connected to the second shaft by means of e.g. a band 10, wire or the like. Reverting to FIG. 3, as the compression spring arrangement 13 is moved and thereby also the second shaft 8, also the band 10 moves. The band 10 moves from a position in which the control circuit of the contactor 2 is supplied through the switch 9 to a position in which this supply is cut off. Thereby, when the handle 14 is turned, the first (mechanical) means 7, 8 of the disconnector 3 as well as the second (electrical) means 9, 10 thereof are operated essentially simultaneously. In other embodiments, the second means comprises a simple on-off switch, which is manually operated.

Figure 4:
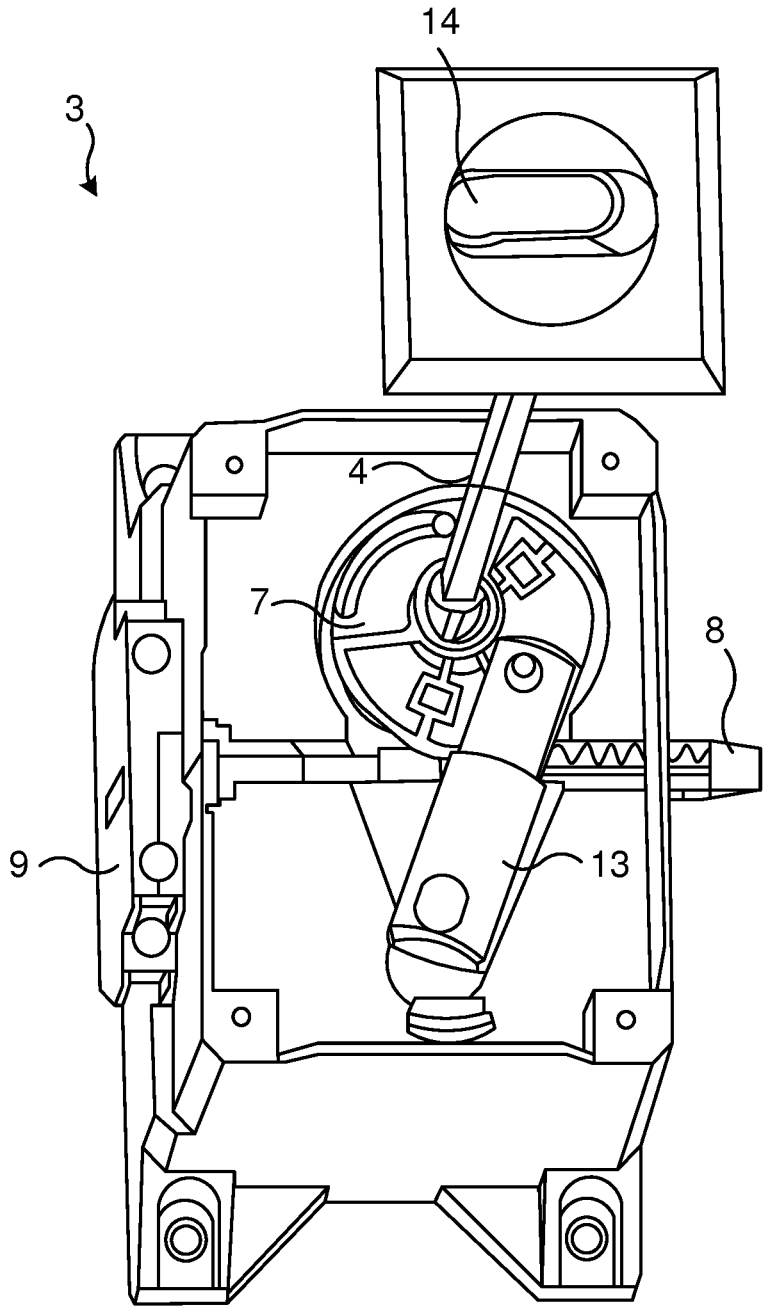
FIG. 4 illustrates the disconnector according to the present invention in a cross-sectional view from above in open position.

FIG. 4 illustrates the disconnector 3 according to the present invention in a cross-sectional view from above, when in OFF-position. OFF-position in this regards means that the contactor 2 is locked in its open position, i.e. the contacts of the contactor 2 are not leading the current to the electrical circuit or device that it is arranged to switch. When the handle 14 is turned to OFF-position the first means 7, 8 and the second means 9, 10 of the disconnector 3 are operated. The second means 9, 10 ensures that the contactor control circuitry is opened and the contactor 2 is de-energized regardless of any control signal and it will open. The first means 7, 8 ensures that the second shaft 8 enters into the contactor 2 so as to mechanically lock the contacts of the contactor 2. Thus, when the handle 14 is in its OFF-position the contactor 2 becomes not only electrically blocked but also mechanically locked.

In order to still further increase the security, the handle 14 may be provided with means for being locked in its OFF-position. Such means may for instance comprise a built-in locking feature. In other embodiments, the handle 14 may be locked in its OFF-position by means of e.g. a padlock. In such embodiments, the handle 14 may be provided with means for entering a padlock in such way as to prevent turning of the handle 14.

The above embodiment described with reference to FIGS. 3 and 4 comprise a linearly moving second shaft 8 that is coupled to the first shaft 4 which rotates when the handle 14 is turned, however and as has been indicated, several other design options are conceivable.

An arrangement 1 is also provided, comprising the contactor 2 and the disconnector 3 as have been described. That is, the disconnector 3 is a built-in feature in an improved contactor together constituting the arrangement 1.

The invention has mainly been described herein with reference to a few embodiments. However, as is appreciated by a person skilled in the art, other embodiments than the particular ones disclosed herein are equally possible within the scope of the invention, as defined by the appended patent claims.

The invention claimed is:

1. A disconnector device for disconnecting an electrical circuit, wherein the electrical circuit is switched by a contactor between an open position and a closed position, wherein the disconnector device uses the contactor for disconnecting the electric circuit, the disconnector device comprising:

first means for mechanically locking the contactor in the open position, in which open position contacts of the contactor are in a first position disconnecting the electrical circuit, and second means for electrically preventing control circuitry of the contactor to operate, the second means being connected electrically to the control circuitry of the contactor.

2. The disconnector as claimed in claim 1, including means for preventing the means for locking the contactor in the open position to be fully operated if the contactor cannot assume the open position.

3. The disconnector as claimed in claim 1, wherein the means for locking the contactor in the open position includes a second shaft inserted into a housing of the contactor, the second shaft mechanically preventing the contacts of the contactor to assume the closed position.

4. The disconnector device as claimed in claim 1, including a first shaft arranged to operate:

first means to mechanically lock the contactor in the open position, and second means to the prevent control circuitry of the contactor to operate.

5. The disconnector device as claimed in claim 4, wherein the first shaft is arranged to operate the first means and the second means in a single movement.

6. The disconnector device as claimed in claim 1, wherein the means for locking the contactor in open position includes a gear operated by a first shaft, wherein the gear when operated moves a second shaft to a locking position within a housing of the contactor, in which position the contactor is locked in the open position.

7. The disconnector device as claimed in claim 6, wherein the first shaft is prevented from being fully operated if the contactor cannot assume the open position and the second shaft thereby being prevented from assuming the locking position.

8. The disconnector device as claimed in claim 1, wherein the means for locking the contactor in open position includes a switch connected electrically to control circuitry of the contactor, the switch de-energizing the control circuitry of the contactor when operated.

9. An arrangement for disconnecting an electrical circuit, wherein the electrical circuit is switched by a contactor between an open position and a closed position, the disconnector device using the contactor for disconnecting the electric circuit, the arrangement including:

a contactor arranged to switch an electrical circuit between an open position and a closed position, and a disconnector device as claimed in claim 1, arranged to disconnect the electric circuit.

10. The disconnector as claimed in claim 2, wherein the means for locking the contactor in the open position includes a second shaft inserted into a housing of the contactor, the second shaft mechanically preventing the contacts of the contactor to assume the closed position.

11. The disconnector device as claimed in claim 2, including a first shaft arranged to operate:

first means to mechanically lock the contactor in the open position, and second means to the prevent control circuitry of the contactor to operate.

12. The disconnector device as claimed in claim 2, wherein the means for locking the contactor in open position includes a gear operated by a first shaft, wherein the gear when operated moves a second shaft to a locking position within a housing of the contactor, in which position the contactor is locked in the open position.

13. The disconnector device as claimed in claim 2, wherein the means for locking the contactor in open position includes a switch connected electrically to control circuitry of the contactor, the switch de-energizing the control circuitry of the contactor when operated.

14. A disconnector device for disconnecting an electrical circuit, wherein the electrical circuit is switched by a contactor between an open position and a closed position, wherein the disconnector device uses the contactor for disconnecting the electric circuit, the disconnector device comprising:

a mechanical device for locking the contactor in the open position, in which open position contacts of the contactor are in a first position disconnecting the electrical circuit, and an electrical device for preventing control circuitry of the contactor to operate, the electrical device being connected electrically to the control circuitry of the contactor.

* * * * *